US007559886B2

(12) United States Patent
Knyrim

(10) Patent No.: US 7,559,886 B2
(45) Date of Patent: Jul. 14, 2009

(54) MASSAGING APPLIANCE

(76) Inventor: Jorg Knyrim, Kaiserstrasse 191, 76133 Karlsruhe (DE)

( * ) Notice: Subject to any disclaimer, the term of this patent is extended or adjusted under 35 U.S.C. 154(b) by 338 days.

(21) Appl. No.: 10/589,609

(22) PCT Filed: Feb. 24, 2005

(86) PCT No.: PCT/DE2005/000312

§ 371 (c)(1),
(2), (4) Date: Aug. 16, 2006

(87) PCT Pub. No.: WO2005/084605

PCT Pub. Date: Sep. 15, 2005

(65) Prior Publication Data

US 2007/0179336 A1 Aug. 2, 2007

(30) Foreign Application Priority Data

Mar. 4, 2004 (DE) ..... 10 2004 011 200
Jul. 14, 2004 (DE) ..... 10 2004 033 932

(51) Int. Cl.
*A61H 1/00* (2006.01)

(52) U.S. Cl. ..... 600/38

(58) Field of Classification Search ..... 601/72, 601/80, 97, 101–103, 112–114, 123, 126, 601/125, 129, 130, 135, 137; 600/38–41
See application file for complete search history.

(56) References Cited

U.S. PATENT DOCUMENTS

| | | | | |
|---|---|---|---|---|
| 4,162,675 | A * | 7/1979 | Kawada | 601/111 |
| 6,402,710 | B1 * | 6/2002 | Hsu | 601/113 |
| 6,632,185 | B2 * | 10/2003 | Chen | 601/101 |
| 2006/0047181 | A1 * | 3/2006 | Hsu | 600/38 |
| 2006/0069330 | A1 * | 3/2006 | Nan | 601/72 |

FOREIGN PATENT DOCUMENTS

| | | |
|---|---|---|
| FR | 2 655 271 | 6/1991 |
| GB | 2 392 622 | 3/2004 |
| WO | WO 2004/036369 | 4/2004 |

* cited by examiner

*Primary Examiner*—Samuel G Gilbert
(74) *Attorney, Agent, or Firm*—Hoffman, Wasson & Gitler, P.C.

(57) ABSTRACT

Rod-shaped massaging appliance with an essentially cylindrical end piece, with a wall or shell made of a rubber-elastic material forming the outer surface of the end piece and with a drive unit for generating movement on the end piece.

47 Claims, 2 Drawing Sheets

MASSAGING APPLIANCE

BACKGROUND OF THE INVENTION

The invention relates to a massaging appliance with an essentially cylindrical piece, with a wall or shell made of rubber elastic material and with a drive unit for generating movement on the end piece. Such massaging appliance for insertion into body cavities, e.g. the vagina, are known in the art (e.g. EP 0 472 965 A1).

It is an object of the present invention is to present a massaging appliance with an innovative effect.

SUMMARY OF THE INVENTION

The cylindrical device has a drive unit. The drive unit has a plurality of bearing and support surfaces against which a shell bears, and the drive unit is designed for oscillating deformation of the shell relative to a longitudinal axis of the end piece, of the device, radially inward and outward, so that this deformation takes place along the longitudinal axis of the end piece and/or in the peripheral direction of the end piece, in a phase delayed manner.

BRIEF DESCRIPTION OF THE DRAWINGS

The invention is described in more detail below based on exemplary embodiments with reference to the drawings, wherein.

DETAILED DESCRIPTION OF THE INVENTION

Figure 1:
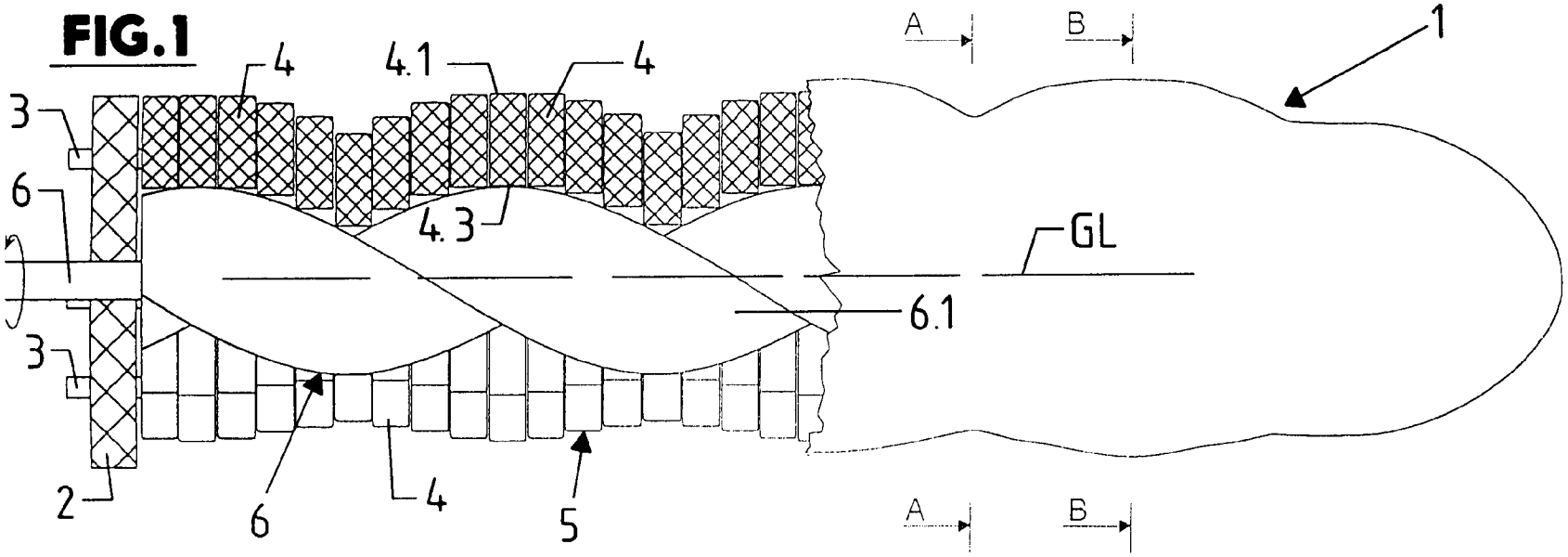
FIG. 1 shows a massaging appliance according to the invention in side view, partially in longitudinal section.

The massaging appliance generally designated 1 in FIG. 1 consists of a support or, in the depicted embodiment, a plate-shaped base 2, on which a plurality of guide and support elements 3 are fastened, said elements extending in the longitudinal direction of the appliance 1 and protruding over one side of the base 2 and being rod-shaped in the depicted embodiment. The guide and support elements 3 provided at a distance from one another and oriented in the longitudinal direction of the appliance 1 form three groups, each with two guide and support elements in the depicted embodiment. The groups are offset from one another by 120° on the longitudinal axis of the appliance 1, so that the axes of the two guide and support elements 3 of each group are at the same radial distance from the longitudinal axis GL and are at a distance from each other.

A plurality of jaws or plates 4 are arranged on the guide and support elements 3. The jaws 4 in the depicted embodiment have a flat or graduated disk shape, so that three such jaws form one disk-shaped set of jaws. The jaws 4 or the sets of jaws formed by said jaws and oriented with their surface sides perpendicular to the longitudinal axis of the massaging appliance are provided consecutively in the manner of a stack in the longitudinal direction of the appliance 1 to form a jaw stack 5. Each jaw 4 is movably guided relative to the axis GL by means of oblong holes 4.1 on the two guide and support elements 3 of one support element group. The outer surfaces 4.2 of the jaws are designed in the depicted embodiment in the shape of a partial cylinder surface. The outer diameter of the layers formed by three jaws 4 changes along the axis GL, in the depicted embodiment such that the outer diameter of these layers is reduced on the end facing away from the base 2.

On the same axis with the axis GL, in the base 2 and between the jaws 4, one shaft 6 is rotatably mounted on bearings, said shaft having a non-circular cross section on its shaft section 6.1 located between the jaws 4, i.e. in the depicted embodiment a triangular cross section, which is twisted along the axis GL so that the extremities or corner points of said cross section lie on a helical line on the axis of the shaft 6. The jaws 4 bear with the inner bearing surfaces 4.3 against the shaft section 6.1. The base 2 and the jaw or plate arrangement 5 formed by the jaws 4 or jaw layers is covered with a shell 7 made of a rubber-elastic material, over which also the jaws 4 are pre-tensioned in a retracted position with the smaller distance from the axis GL.

The shaft 7 is driven by a drive unit not depicted, by means of which via the shaft section 6.1 a radial movement of the jaws 4, which with their bearing surfaces 4.3 work together with said shaft section, is achieved radially to the axis GL, so that the jaws 4, following the helical path of the corner areas of the cross section of the shaft section 6.1 along the longitudinal extension of the appliance 1 are moved varyingly radially outward at any point in time, thus resulting in a wave-like movement on the outer surface of the shell 7. This means that the phase of the stroke motion of the jaws 4 in the longitudinal direction GL changes, i.e. at any point in time some of the jaws 4 are in their retracted inner position, some of the jaws 4 are in the furthest radially outward position and some of the jaws 4 are in positions in between, as depicted in FIG. 1.

Figure 4:
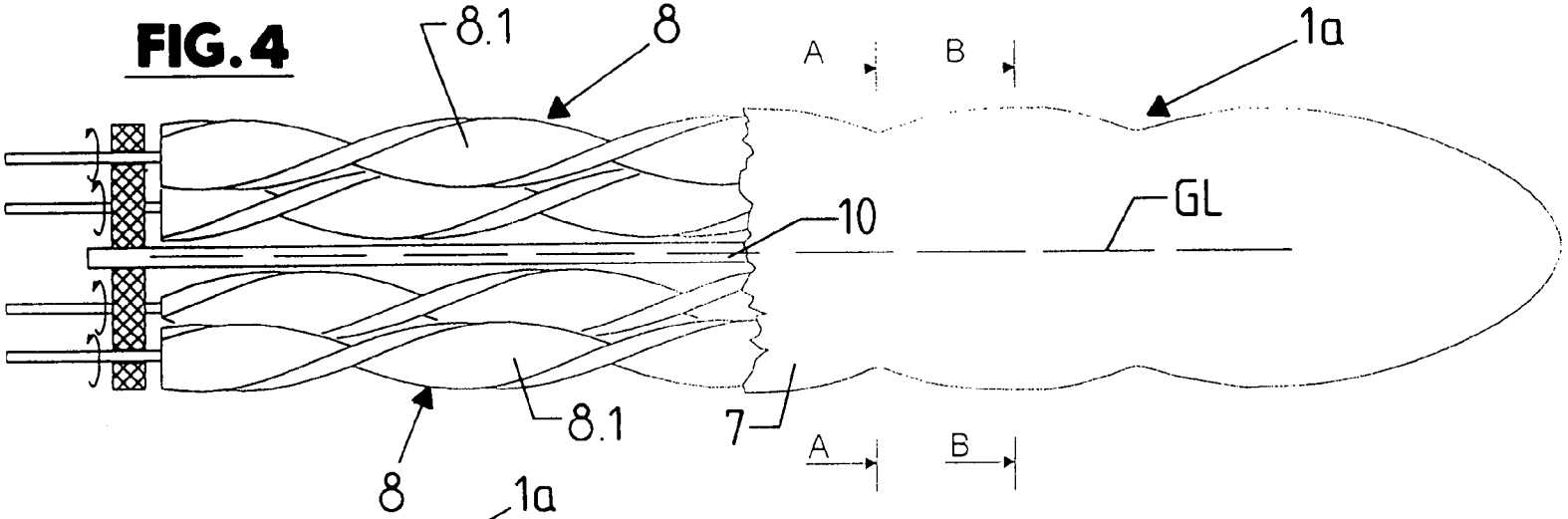
FIG. 4 shows a further possible embodiment of the invention in a depiction similar to FIG. 1.
Figure 6:
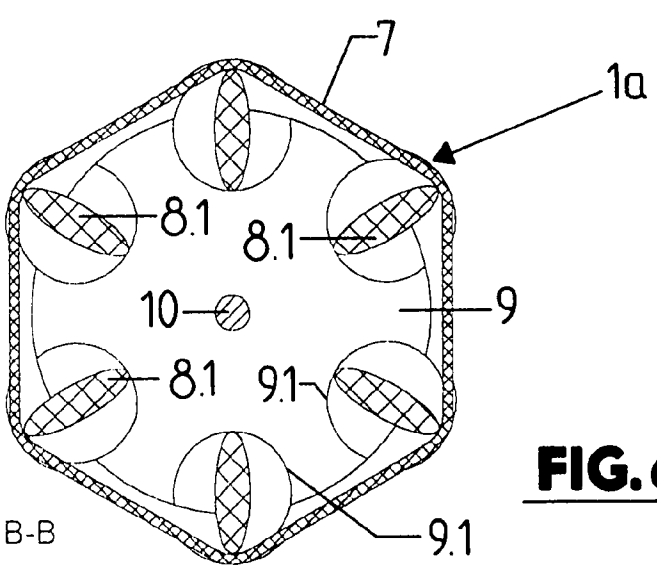
FIGS. 5 and 6 show sections corresponding to the lines A-A and B-B of FIG. 4.
Figure 5:
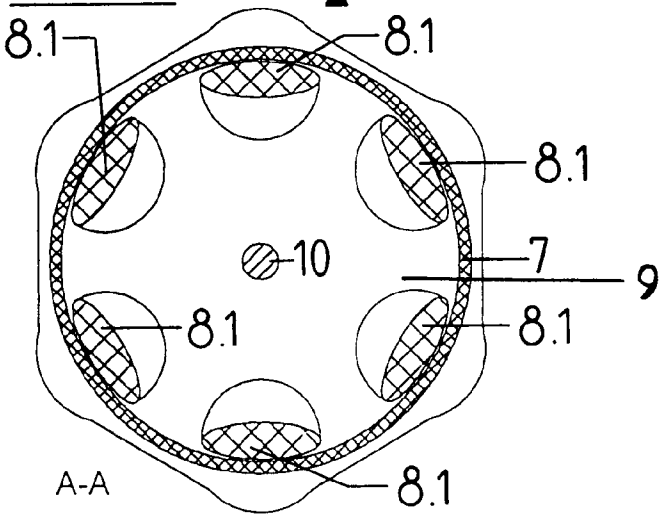

FIGS. 4-6 show as a further possible embodiment a appliance 1*a*, which differs from the appliance 1 essentially in that instead of the radially moved jaws, several shafts 8 are provided, which are rotatably mounted in the base 2 and extend with shaft sections 8.1 over one side of the base 2. The shafts 8 oriented with their axis in the direction of the longitudinal axis GL of the appliance 1*a* are distributed at regular angle intervals on said longitudinal axis. Furthermore, in the direction of the axis GL and at a distance from the base 2, support disks 9 are provided that are oriented with their surface sides perpendicular to the axis GL and are held on a support element 10 that is rod-shaped in the depicted embodiment and that is oriented on the same axis as the axis GL and is held at one end on the base 2. The support disks 9 form partially circular recesses or cutouts 9.1 on their periphery that are open toward the periphery and in which the shaft 8 is partially held with its shaft sections 8.1 and which form a support for the shaft sections 8.1.

The shaft sections 8.1 again have a non-circular cross section, i.e. in the depicted embodiment an oval cross section, which is twisted in the longitudinal direction of the shaft 8 so that the extremities of this cross section, i.e. the two outermost and most widely spaced areas of the oval cross section are each arranged on a helical line on the axis of the respective shaft 8.

In the depicted embodiment, a total of six shafts 8 are provided, offset, on the axis GL. The arrangement, formed by the shafts 8.1, the base 2 and the support elements or disks 9, of the shell 7, which is again made of the rubber-elastic material, is closed toward the outside. Furthermore, the design is such that when the shafts 8 are rotating, the shell 7 is also pressed elastically outward at the point where the cross section of the shaft sections 8.1 with the largest cross section axis is no longer tangential to an imaginary circular line around the axis GL. The least deformation of the shell 7 then exists at the point where the cross section of the respective shaft section 8.1 with its largest cross section axis is oriented tangentially to the imaginary circular arc around the axis GL (FIG. 5), and the greatest deformation of the shell 7 exists at the point where the largest cross section axis is oriented radially to the axis GL (FIG. 6). The shafts 8 can be driven by a common drive unit not depicted.

Plastic is an especially suitable material for the base 2, the guide and support elements 3, the jaws 4, the shafts 6 and 8, the support elements 9 and the support element 10.

All embodiments have in common the fact that within a rubber-elastic shell 7 forming the outer surface of the appliance, support elements are provided for said shell that are part of an actuating mechanism, with which a radial stroke motion is achieved on the outer surface of the shell, namely with a phase for the stroke motion that changes in the longitudinal and/or peripheral direction of the appliance.

Figure 3:
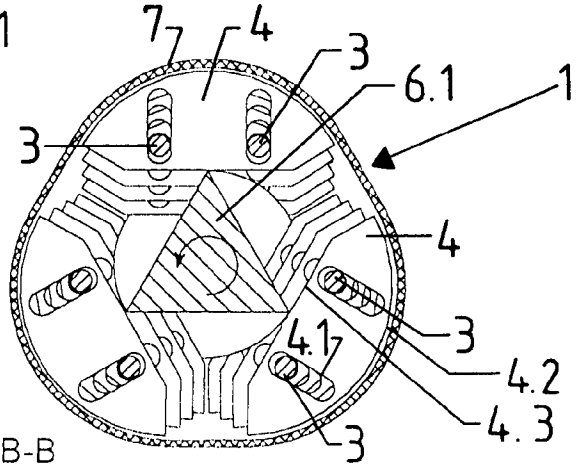
FIGS. 2 and 3 show sections corresponding to the lines A-A and B-B of FIG. 1.
Figure 2:
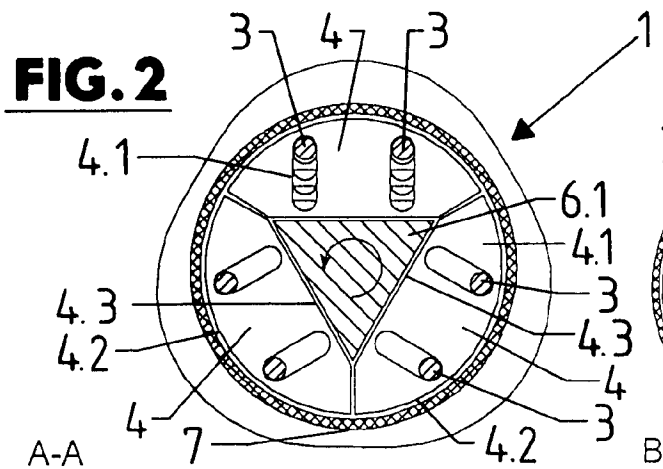

The invention was described above based on exemplary embodiments. It goes without saying that numerous modifications and variations are possible without abandoning the underlying inventive idea upon which the invention is based. For example, the support elements 9 can be eliminated. Furthermore, it was assumed in the embodiment in FIGS. 1-3 that the number of eccentric areas of the shaft 6 is equal to the number of support elements in each group or plane. Embodiments are also conceivable in which the number of eccentric areas is greater than the number of support elements in each group or plane.

REFERENCE LIST

1, 1*a* massaging appliance
2 base
3 guide and support element
4 jaws
4.1 oblong hole
4.2 peripheral surface
4.3 bearing surface
5 jaw array
6 shaft
6.1 shaft section
7 shell
8 shaft
8.1 shaft sections
9 support or supporting plate
9.1 cutout or recess
10 support element

What is claimed is:

1. A rod-shaped massaging appliance with an essentially cylindrical end piece, with a wall or shell made of a rubber-elastic material forming an outer surface of the end piece and with a drive unit for generating movement on the end piece, wherein the drive unit forms a plurality of bearing and support surfaces, against which the shell bears, and that the drive unit is designed for an oscillating deformation of the shell relative to a longitudinal axis of the end piece radially outward and inward, so that this deformation takes place along the longitudinal axis of the end piece and in the peripheral direction of the end piece.

2. The massaging appliance according to claim 1, wherein the bearing or support surfaces for the shell are formed by a plurality of support elements, which can be driven by at least one drive element for a radial stroke motion.

3. The massaging appliance according to claim 2, wherein the support elements are jaws.

4. The massaging appliance according to claim 2, wherein several support elements are arranged respectively in a common plane perpendicular to the longitudinal extension of the end piece and form one group of support elements, and that a plurality of such groups is provided successively in the longitudinal direction of the end piece.

5. The massaging appliance according to claim 1, whereby for moving the support surfaces and/or the support elements forming said support surfaces, at least one shaft forming at least one eccentric section is provided, which said shaft works together with the support elements and can be driven by a drive unit.

6. The massaging appliance according to claim 5, wherein the at least one eccentric section extends parallel or approximately parallel to the axis of the shaft at least over a partial length of the at least one shaft.

7. The massaging appliance according to claim 5, wherein the at least one eccentric section extends diagonally to the axis of the shaft at least over a partial length of the at least one shaft.

8. The massaging appliance according to claim 5, wherein the at least one eccentric section is twisted along the axis of the at least one shaft so that it extends on a helical line on the axis of the shaft.

9. The massaging appliance according to claim 5, wherein the at least one eccentric section is formed by one edge of the at least one shaft.

10. The massaging appliance according to claim 5, wherein the eccentric section is formed by the fact that the at least one shaft has, at least on its shaft section working together with the support elements, a non-circular cross section, a polygonal or an essentially polygonal cross section, triangular or rectangular.

11. The massaging appliance according to claim 1, wherein a single shaft working together with the support elements.

12. The massaging appliance according to claim 1, further comprising a plurality of shafts working together with the support elements.

13. The massaging appliance according to claim 1, wherein the eccentric section of the at least one shaft working together with the support elements features a plurality of eccentric surfaces or areas.

14. The massaging appliance according to claim 13, wherein the number of eccentric areas or surfaces is equal to the number of support elements in each group of such elements.

15. The massaging appliance according to claim 13, wherein the number of eccentric areas or surfaces is different from the number of support elements in each group of such elements.

16. The massaging appliance according to claim 1, wherein the inner bearing and support surfaces for the shell are formed by eccentric sections of shafts that are oriented with their longitudinal extension in the direction of the longitudinal axis (GL) of the end piece and can be driven by a drive unit.

17. The massaging appliance according to claim 16, wherein the at least one eccentric section of the respective shaft extends parallel or approximately parallel to the axis of the shaft at least over a partial length of the shaft.

18. The massaging appliance according to claim 16, wherein the at least one eccentric section of the respective shaft extends diagonally to the axis of the shaft at least over a partial length of the shaft.

19. The massaging appliance according to claim 16, wherein the at least one eccentric section of the respective shaft is twisted at least on a partial length along the axis of the shaft so that it extends on a helical line on the axis of the shaft.

20. The massaging appliance according to claim 16, wherein the at least one eccentric section is formed by one edge of the respective shaft.

21. The massaging appliance according to claim 16, wherein the eccentric section is formed by the fact that the respective shaft has a non-circular cross section, a polygonal or an essentially polygonal cross section, triangular or rectangular.

22. The massaging appliance according to claim 1, wherein at least two eccentric areas or surfaces offset on the axis of the shaft are formed on the eccentric section.

23. The massaging appliance according to claim 1, wherein at least one support element is provided for several shafts, each featuring one eccentric section.

24. The massaging appliance according to claim 1, wherein said deformation is phase delayed.

25. A rod-shaped massaging appliance with an essentially cylindrical end piece, with a wall or shell made of a rubber-elastic material forming an outer surface of the end piece and with a drive unit for generating movement on the end piece, wherein the drive unit forms a plurality of bearing and support surfaces, against which the shell bears, and that the drive unit is designed for an oscillating deformation of the shell relative to a longitudinal axis of the end piece radially outward and inward, so that this deformation takes place along the longitudinal axis of the end piece or in the peripheral direction of the end piece, wherein for moving the bearing and support surfaces at least one shaft forming at least one eccentric section is provided.

26. The massaging appliance according to claim 25, wherein the bearing or support surfaces for the shell are formed by a plurality of support elements, which can be driven by at least one drive element for a radial stroke motion.

27. The massaging appliance according to claim 26, wherein the support elements are jaws.

28. The massaging appliance according to claim 26, wherein several support elements are arranged respectively in a common plane perpendicular to the longitudinal extension of the end piece and form one group of support elements, and that a plurality of such groups is provided successively in the longitudinal direction of the end piece.

29. The massaging appliance according to claim 25, wherein the at least one eccentric section extends parallel or approximately parallel to the axis of the shaft at least over a partial length of the at least one shaft.

30. The massaging appliance according to claim 25, wherein the at least one eccentric section extends diagonally to the axis of the shaft at least over a partial length of the at least one shaft.

31. The massaging appliance according to claim 25, wherein the at least one eccentric section is twisted along the axis of the at least one shaft so that it extends on a helical line on the axis of the shaft.

32. The massaging appliance according to claim 25, wherein the at least one eccentric section is formed by one edge of the at least one shaft.

33. The massaging appliance according to claim 25, wherein the eccentric section is formed by the fact that the at least one shaft has, at least on its shaft section working together with the support elements, a non-circular cross section, a polygonal or an essentially polygonal cross section, triangular or rectangular.

34. The massaging appliance according to claim 25, wherein a single shaft working together with the support elements.

35. The massaging appliance according to claim 25, further comprising a plurality of shafts working together with the support elements.

36. The massaging appliance according to claim 25, wherein the eccentric section of the at least one shaft working together with the support elements features a plurality of eccentric surfaces or areas.

37. The massaging appliance according to claim 36, wherein the number of eccentric areas or surfaces is equal to the number of support elements in each group of such elements.

38. The massaging appliance according to claim 36, wherein the number of eccentric areas or surfaces is different from the number of support elements in each group of such elements.

39. The massaging appliance according to claim 25, wherein the inner bearing and support surfaces for the shell are formed by eccentric sections of shafts that are oriented with their longitudinal extension in the direction of the longitudinal axis (GL) of the end piece and can be driven by a drive unit.

40. The massaging appliance according to claim 39, wherein the at least one eccentric section of the respective shaft extends parallel or approximately parallel to the axis of the shaft at least over a partial length of the shaft.

41. The massaging appliance according to claim 39, wherein the at least one eccentric section of the respective shaft extends diagonally to the axis of the shaft at least over a partial length of the shaft.

42. The massaging appliance according to claim 39, wherein the at least one eccentric section of the respective shaft is twisted at least on a partial length along the axis of the shaft so that it extends on a helical line on the axis of the shaft.

43. The massaging appliance according to claim 39, wherein the at least one eccentric section is formed by one edge of the respective shaft.

44. The massaging appliance according to claim 39, wherein the eccentric section is formed by the fact that the respective shaft has a non-circular cross section, a polygonal or an essentially polygonal cross section, triangular or rectangular.

45. The massaging appliance according to claim 25, wherein at least two eccentric areas or surfaces offset on the axis of the shaft are formed on the eccentric section.

46. The massaging appliance according to claim 25, wherein at least one support element is provided for several shafts, each featuring one eccentric section.

47. The massaging appliance according to claim 25, wherein said deformation is phase delayed.

* * * * *